US005695051A

United States Patent [19]

Hart

[11] Patent Number: 5,695,051

[45] Date of Patent: Dec. 9, 1997

[54] COMPOSITE CARRIER CARTON

[75] Inventor: Joseph J. Hart, Philadelphia, Pa.

[73] Assignee: Jefferson Smurfit Corporation, Clayton, Mo.

[21] Appl. No.: 609,654

[22] Filed: Mar. 1, 1996

[51] Int. Cl.[6] ..... B65D 71/68; B65D 71/56

[52] U.S. Cl. ..... 206/198; 206/162

[58] Field of Search ..... 206/143, 144, 206/162, 183–193, 198

[56] References Cited

U.S. PATENT DOCUMENTS

| | | | |
|---|---|---|---|
| 2,747,767 | 5/1956 | Bergstein | 206/190 |
| 3,084,831 | 4/1963 | Arneson | 206/191 |
| 3,191,800 | 6/1965 | Kowal | 206/191 |
| 4,171,046 | 10/1979 | Bonczyk | 206/193 |
| 4,308,950 | 1/1982 | Wood | 206/189 |

*Primary Examiner*—Jimmy G. Foster
*Attorney, Agent, or Firm*—Richard W. Carpenter

[57] ABSTRACT

A carrier carton formed from a composite blank of paperboard and paper. The carton is designed like a seal end carton with identical halves foldably joined to each other and secured to each other in back-to-back relation to provide a reinforced, four-ply handle construction. Transverse partitions include panels foldably joined to a center wall and attached to partition elements foldable joined to the side walls. The carton also has a solid bottom wall construction including bottom closure flaps foldably joined to each of the carton walls and adhesively secured to each other in overlapped relation.

19 Claims, 2 Drawing Sheets

FIG. 1
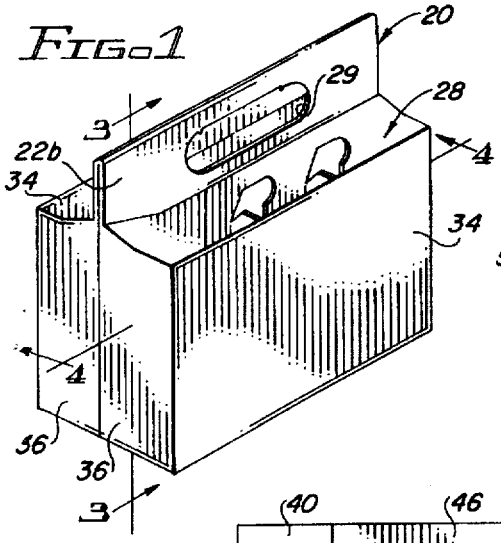
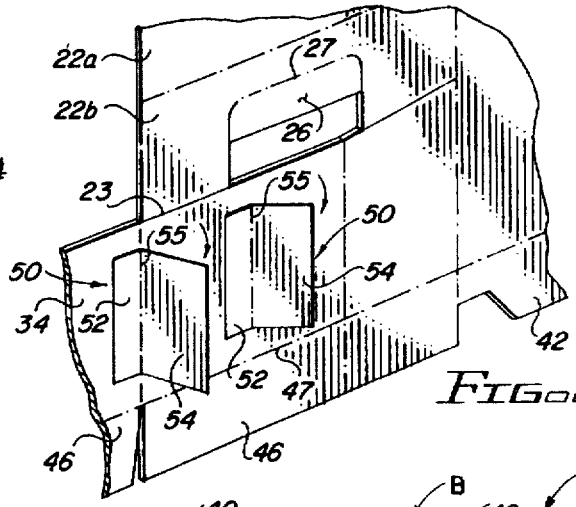
FIG. 5
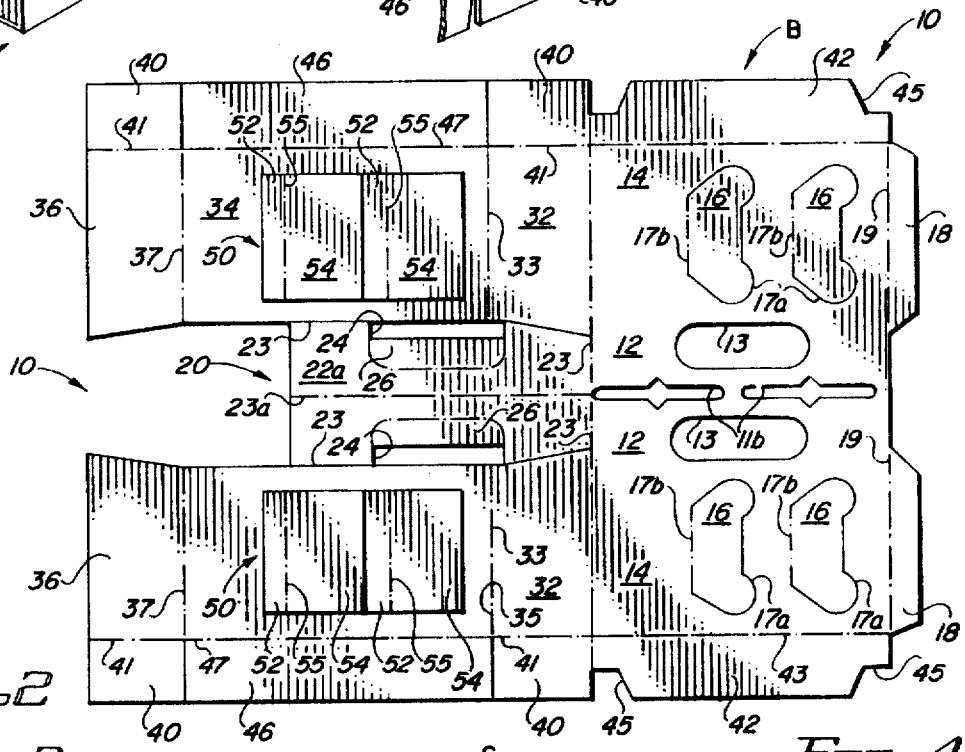
FIG. 2
FIG. 3
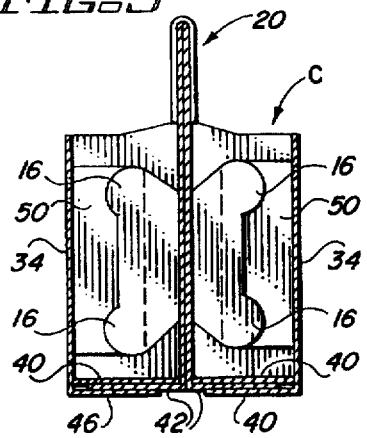
FIG. 4
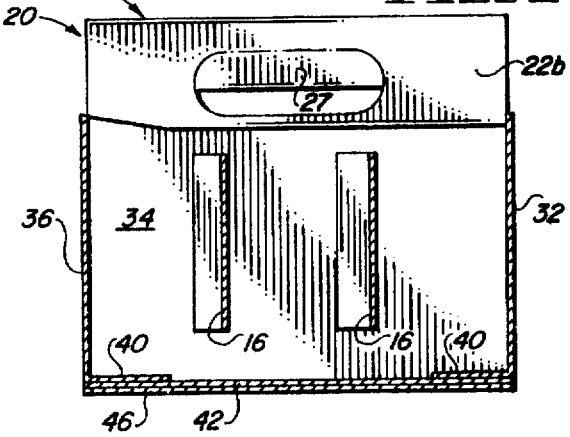

COMPOSITE CARRIER CARTON

BACKGROUND OF THE INVENTION

1. Field of the Invention

This invention relates to paperboard, multi-cell, basket style, carrier cartons of the type used to hold and transport articles, such as beverage bottles and the like, and more particularly to an improved carton that has both bottom wall and handle constructions that are far more rigid than corresponding constructions of conventional carrier cartons, but which require less material and can be manufactured and assembled more efficiently and economically than conventional carrier cartons.

2. Description of the Background Art

A background art search directed to the subject matter of this invention conducted in the United States Patent and Trademark Office disclosed the following U.S. Patents:

| | | | |
|---|---|---|---|
| 3,115,273 | 3,191,800 | 3,229,849 | 3,266,663 |
| 3,352,452 | 3,400,856 | 3,724,714 | 4,205,748 |
| 4,319,682 | 4,402,400 | 4,406,365 | 4,480,746 |
| 4,741,436 | 5,040,672 | | |

None of the patents uncovered in the search discloses a multi-cell carrier carton that is designed like a seal end carton with identical halves foldably joined to each other and secured to each other in back-to-back relation to provide a four-ply handle construction and a solid bottom wall construction

SUMMARY OF THE INVENTION

It is a primary object of the invention to provide a multi-cell, basket style, paperboard carrier carton that has a bottom wall construction and a handle construction that are both far more substantial than the constructions of conventional carrier cartons, but which require less material and can be manufactured and assembled more efficiently and economically.

Another object of the invention is the provision of a carrier carton of the type described that is designed like a seal end carton with identical halves foldably joined to each other and secured to each other in back-to-back relation to provide a four-ply handle construction and a solid bottom wall construction.

A more specific object of the invention is the provision of a carton of the type described that has a pair of center partition and handle forming panels each including transverse partition panels joined to opposed side wall panels by separate transverse partition elements having opposite ends attached to said transverse partition panels and said side wall panels, respectively.

These and other objects of the invention will be apparent from an examination of the following description and drawings.

BRIEF DESCRIPTION OF THE DRAWINGS

FIG. 1 is an isometric view of a carrier carton embodying features of the invention, shown as seen from above;

FIG. 2 is a plan view of a blank of paperboard from which the carrier carton illustrated in the other views may be formed;

FIGS. 3 and 4 are vertical sectional views taken on lines 3—3 and 4—4, respectively, of FIG. 1;

FIG. 5 is a partial isometric view of the interior of the carton showing partition elements attached to a side wall panel;

Figure 6A:
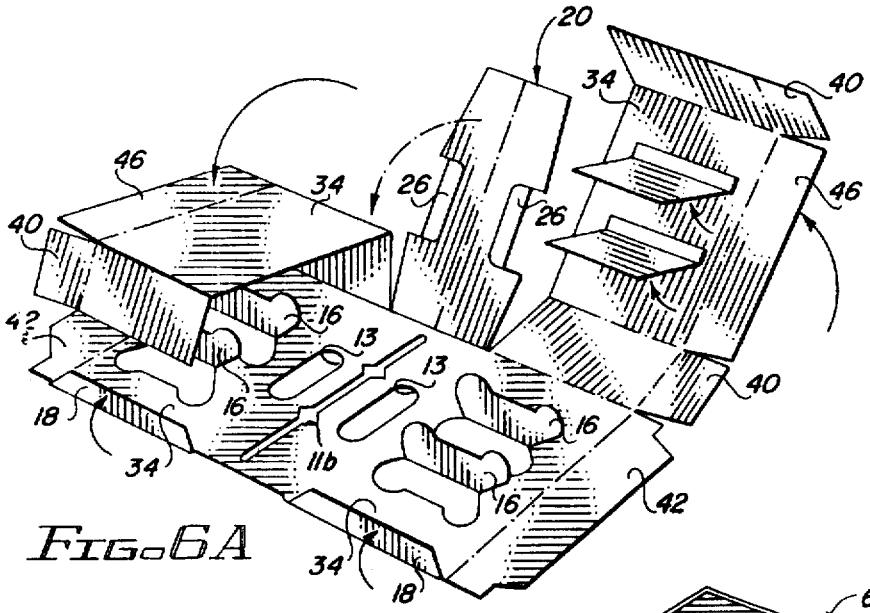
FIGS. 6A–6D are isometric views showing various steps in erecting the carrier carton illustrated in FIG. 1 from the carton blank illustrated in FIG. 2.

It will be understood that, for purposes of clarity, certain elements may have been omitted from certain views where they are believed to be illustrated to better advantage in other views.

DESCRIPTION OF THE PREFERRED EMBODIMENT

Referring now to the drawings for a better understanding of the invention, it will be seen that the multi-cell, basket style, carrier carton, indicated at C in FIG. 1, may be formed from the unitary body forming blank B of foldable paperboard and the separate partition patches or elements 50 illustrated in FIG. 5.

As best seen in FIGS. 1, and 5, Carton C includes side wall panels 34, end wall panels 32 and 36, a bottom wall 48, and a center wall 28 that includes, in an upper portion thereof, a handle hole 29, and, in a lower portion thereof, transverse partition panels 18 which are joined to the side wall panels 34 by separate partition elements 50.

Turning now to FIG. 5, it will be seen that center wall 28 is formed from a pair of longitudinal partition forming center wall panels 10, which are joined to each other at the top of the carton by a pair of relatively short fold lines 11*a*, and which are separated from each other by a pair of openings 11*b*.

Each center wall panel 10 includes an upper handle forming inner section 12, with a handle opening 13 extending therethrough, and a lower partition forming section 14, including a plurality of transverse partition panels 16 formed from material thereof and each defined by a cut line 17*a* and a fold line 17*b*.

Each panel 10 also includes a glue flap 18 foldably joined to a side edge of thereof along a fold line 19.

Still referring to FIG. 5, it will be seen that blank B includes an outer handle section 20 having a pair of panels 22*a* which are foldably joined along fold lines 23 to upper portions of adjacent center wall panels 10 and foldably joined to each other along a fold line 23*a*.

Body blank B also includes a pair of end and side wall forming sections 30, each of which includes a first end wall panel 32, foldably joined along a fold line 33 to a lower portion of longitudinal partition panel 10, a side wall panel 34, foldably joined at one side edge along a fold line 35 to an adjacent side edge of adjacent first end wall panel 32, and a second end wall panel 36, foldably joined along a fold line 37 to another side edge of adjacent side wall panel 34.

Bottom wall 48 of carton C includes a pair of bottom wall sections 48*a*, each of which includes a pair of bottom wall inner panels 40, foldably joined along fold lines 41 to lower edges of end wall panels 32 and 36, a bottom wall intermediate panel 42, foldably joined along a fold line 43 to a lower edge of a related center wall panel 10, and a bottom wall outer panel 46, foldably joined along a fold line 47 to a lower edge of related side wall panel 34.

As best seen in FIGS. 3, and 5, the transverse partitions are formed, partly by the transverse partition panels 16, which extend outwardly from the panels 10 of center wall 28, and partly by separate partition elements of paperboard or paper patches 50.

Each partition element 50 includes a first section 52, adhesively secured to an inner surface of a side wall panel 34, and a second section 54, having an inner edge foldably joined along a fold line 55 to the first section, and having an inboard portion adhesively secured to an outboard portion of a related transverse partition panel 16.

The partition patches or elements 50 may be applied to the carton body blanks either from roll stock or from a stack of patches depending on the desire and/or the equipment of the manufacturer. Together with blank B they form a composite blank.

Figure 6B:
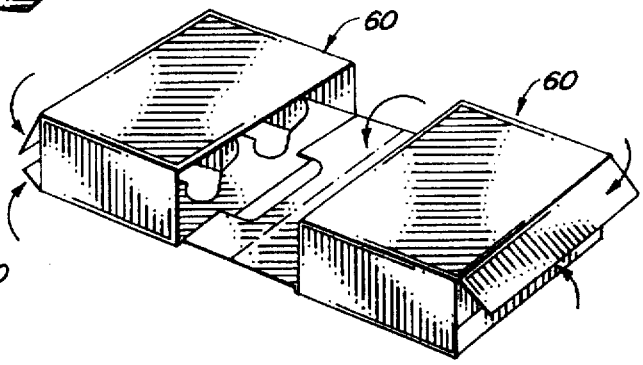

After the carton body blank B has been formed and the partition patches 50 applied to the side wall panels, as previously described and illustrated in FIG. 5, the blank may be folded with the partition patches portions 54 being adhesively secured to the related transverse partition panels 16 and the glue panels 18 being adhesively secured to the second end wall panels 36 to form the flat sleeve-like structure shown in FIGS. 6A and 6B.

At this point the partly formed cartons may be shipped in a flat condition by the carton manufacturer to the carton packer, who can then proceed to complete erection and gluing of the cartons.

When the packer receives the collapsed or flattened carton blanks, the cartons are erected as shown in FIG. 6A, and the bottom wall panels are folded over into overlapped relation and secured to each other, as shown in FIG. 6B.

Figure 7:
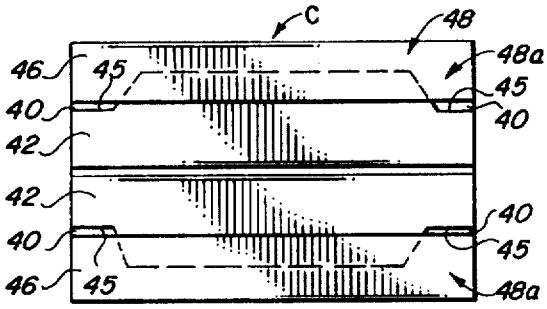
FIG. 7 is a bottom plan view of the carton illustrated in FIG. 1.

As best seen in FIG. 7, bottom wall 48 is completely rigid, because it comprises a pair of rigid, co-planer, bottom wall sections 48*a*. Each section 48*a* includes a pair of inner flaps 40, an intermediate flap 42, and an outer flap 46. Since all of the bottom wall flaps are connected to vertical carton wall panels and adhesively secured to each other, the carton bottom wall is solid and extremely strong and not subject to racking, or side-to-side movement, like most carrier carton bottom walls.

It should be noted that each of the bottom wall intermediate flaps 42 are provided at opposite corners thereof with recesses 45, which allow the bottom wall outer flap 46 to be adhesively secured to the inner flaps 40 as well as to the intermediate flap 45.

Figure 6C:
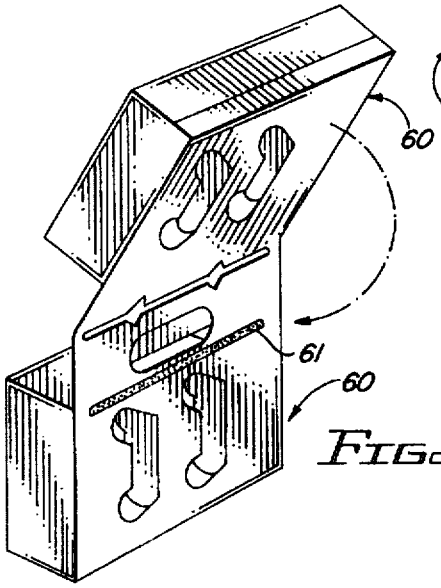
Figure 6D:
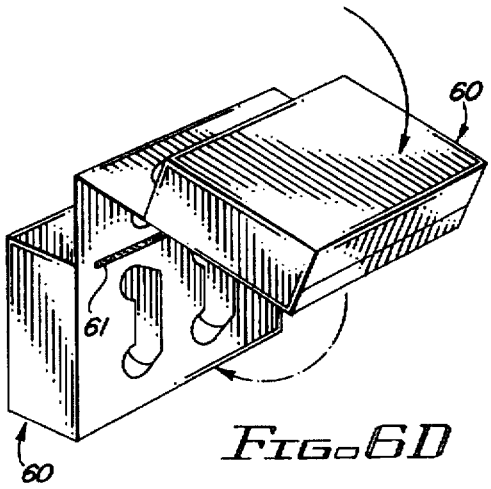

After the bottom wall sections 48*a* have been formed, as shown in FIG. 6B, the two carton halves, indicated at 60, are brought together by folding the center wall panels 10 into back-to-back relation, along fold line 11*a*, and then applying a horizontal strip of hot melt adhesive 61 between the panels in the area of the handle openings to secure the carton halves to each other, as shown in FIGS. 6C and D.

This forms a completely erected and glued carton ready for use in holding and transporting articles.

As an alternative, the carton manufacturer has another option for shipping the partly formed cartons to the packer. In this option the carton manufacturer performs all of the steps shown in FIGS. 6A to 6D, except that the bottom wall flaps are not folded over into overlapped relation and secured to each other.

Instead, the packer receives cartons that are in the same condition as the finished carton shown in FIG. 1, except that they are in collapsed condition with the bottom flaps still unglued and extending downwardly from their respective wall panels.

At this point the packer merely opens the cartons from the flat or collapsed condition and folds and glues the bottom wall flaps to each other in overlapped relation as seen in FIG. 7.

With either arrangement the carton of the present invention combines a paperboard blank with a much less expensive partition patch or element. This allows the design of a much smaller carton body blank requiring far less paperboard than conventional carton carrier blanks, so the over all material costs are less and the carton design is especially good from an environmental standpoint.

The four-ply handle construction coupled, with the bead of hot melt adhesive securing the longitudinal partition panels in back-to-back relation greatly strengthens the handle, and the sol id bottom wall construction also provide a carton that is far stronger and superior, but less expensive to produce, than other cartons.

What is claimed is:

1. A multi-cell, basket style, carrier carton formed from a unitary blank of foldable sheet material, such as paperboard, and a plurality of separate partition blanks, comprising:

(a) a longitudinal partition forming center wall including a pair of center wall panels secured to each other in back-to-back relation;

(b) each of said center wall panels including an upper portion, forming a handle inner section with a handle opening extending therethrough, and a lower portion, forming a longitudinal partition with a plurality of integral transverse partition panels foldably joined thereto and extending outwardly therefrom;

(c) a handle outer section including a pair of panels secured to outer surfaces of adjacent ones of said inner sections and with handle openings aligned with said inner section handle openings;

(d) a pair of side wall panels spaced outwardly from said center wall panels and each being joined to one of said center wall panels by a pair of end wall panels extending therebetween;

(e) a plurality of transverse partition elements interconnecting said side wall panels and related ones of said transverse partition panels to form separate article receiving cells;

(f) bottom closure flaps foldably joined to lower edges of said center wall panels, said side wall panels, and said end wall panels and secured to each other in overlapped relation.

2. A multi-cell, basket style, carrier carton formed from a unitary blank of foldable sheet material, such as paperboard, and a plurality of separate partition blanks, said carton comprising a pair of similar tubular carton sections, each including:

(a) a longitudinal partition forming center wall panel, a side wall panel spaced therefrom, and a pair of end wall panels interconnecting corresponding ends of said center wall panel and said side wall panel;

(b) a plurality of transverse partition panels formed from material of said center wall panel and extending outwardly therefrom toward said side wall panel;

(c) a plurality of transverse partition elements connecting end portions of said transverse partition panels to said side wall panel;

(d) bottom wall closure flaps foldably joined to lower edges of said center wall panel, said side wall panel, and said end wall panels and adhesively secured to each other in overlapped relation;

(e) said center wall panel including an upper portion defining an inner handle section with a handle opening extending therethrough;

(f) an outer handle section positioned over and secured to said inner handle section and having extending therethrough a handle opening aligned with said inner section handle opening;

(g) said center wall panels having upper edges foldably joined to each other and being adhesively secured to each other in back-to-back relation.

3. A composite blank of foldable sheet material for use in forming a multi-cell, basket style carrier carton, comprising:

(a) a pair of longitudinal partition forming center wall panels positioned in end-to-end relation with adjacent ends foldably joined to each other;

(b) each of said center wall panels including one portion, forming a handle inner section with a handle opening extending therethrough, and another portion, forming a longitudinal partition with a plurality of transverse partition panels formed from material thereof and foldably joined thereto;

(c) a handle forming outer section including a pair of panels having corresponding edges foldably joined to adjacent side edges of adjacent ones of said center wall panel inner sections and having handle openings arranged and disposed for alignment with said inner section handle openings;

(d) a pair of first end wall panels located adjacent opposite sides of said handle forming outer section and having corresponding side edges foldably joined to side edges of respective ones of said center wall panels;

(e) a pair of side wall panels having corresponding side edges foldably joined to adjacent side edges of ones of said first end wall panels;

(f) a pair of second end wall panels having corresponding side edges foldably joined to adjacent side edges of respective ones of said side wall panels;

(g) said center wall panels including integral transverse partition panels formed from material thereof and foldably joined thereto;

(h) said side wall panels having separate transverse partition elements attached thereto;

(i) bottom closure flaps foldably joined to lower edges of said center wall panels, said side wall panels, and said end wall panels.

4. A carton according to claim 1, wherein said handle outer section panels are foldably joined to each other and to side edges of ones of said center wall panels.

5. A carton according to claim 2, wherein said handle outer section panels are foldably joined to each other and to side edges of ones of said center wall panels.

6. A carton blank according to claim 3, wherein said handle outer section panels are foldably joined to each other and to side edges of ones of said center wall panels.

7. A carton according to claim 1, wherein said center wall panels are substantially longer than said side wall panels and said end wall panels.

8. A carton according to claim 2, wherein said center wall panels are substantially longer than said side wall panels and said end wall panels.

9. A carton blank according to claim 3, wherein said center wall panels are substantially longer than said side wall panels and said end wall panels.

10. A carton according to claim 1, wherein said transverse partition elements each have a first section adhesively attached to one of said side wall panels and a second section, foldably joined to said first section and adhesively attached to one of said transverse partition panels.

11. A carton according to claim 2, wherein said transverse partition elements each have a first section adhesively attached to said side wall panel and a second section, foldably joined to said first section and adhesively attached to one of said transverse partition panels.

12. A carton blank according to claim 3, wherein said transverse partition elements each have a first section adhesively attached to said side wall panel and a second section, foldably joined to said first section and arranged and disposed to be attached to one of said transverse partition panels.

13. A carton according to claim 1, wherein said transverse partition elements each include a pair of first and second sections foldably joined to each other.

14. A carton according to claim 2, wherein said transverse partition elements each include a pair of first and second sections foldably joined to each other.

15. A carton blank according to claim 3, wherein said transverse partition elements each include a pair of first and second sections foldably joined to each other.

16. A carton according to claim 13, wherein each of said transverse partition element first sections is adhesively secured to an inner surface of one of said side wall panels, and each of said transverse partition element second sections is adhesively secured to a related one of said transverse partition panels.

17. A carton according to claim 14, wherein each of said transverse partition element first sections is adhesively secured to an inner surface of said side wall panel, and each of said transverse partition element second sections is adhesively secured to a related one of said transverse partition panels.

18. A carton according to claim 2, wherein said carton section center wall panels are adhesively secured to each other in back-to-back relation by a horizontally extending line of hot melt adhesive, located in the area of said handle openings, that also serves to reinforce and strengthen said carton handle sections.

19. A carton according to claim 2, wherein said bottom wall closure flaps include a pair of inner flaps, an intermediate flap, and an outer flap, and wherein said outer flap is adhesively secured to said intermediate flap and to both of said inner flaps.

* * * * *